US009127440B2

(12) United States Patent
Seljestad

(10) Patent No.: US 9,127,440 B2
(45) Date of Patent: Sep. 8, 2015

(54) BUCKET THUMB ASSEMBLY

(75) Inventor: Gregory A. Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 638 days.

(21) Appl. No.: 13/301,003

(22) Filed: Nov. 21, 2011

(65) Prior Publication Data

US 2013/0129461 A1 May 23, 2013

(51) Int. Cl.

*E02F 3/413* (2006.01)
*E02F 3/40* (2006.01)
*E02F 9/26* (2006.01)

(52) U.S. Cl.

CPC . *E02F 3/404* (2013.01); *E02F 9/26* (2013.01); *E02F 3/413* (2013.01)

(58) Field of Classification Search

CPC ..... E02F 3/404; E02F 3/413; E02F 3/4131; E02F 3/4133; E02F 3/4135; E02F 3/4136
USPC ..... 37/406, 903; 414/722, 723, 724, 729, 414/739

See application file for complete search history.

(56) References Cited

U.S. PATENT DOCUMENTS

| | | | | |
|---|---|---|---|---|
| 4,033,469 | A | 7/1977 | Frank | |
| 4,531,883 | A | 7/1985 | Arnold | |
| 5,437,145 | A | 8/1995 | Farley et al. | |
| 5,484,250 | A | 1/1996 | Gilmore, Jr. et al. | |
| 5,553,408 | A | 9/1996 | Townsend | |
| 5,813,822 | A | 9/1998 | Pisco | |
| 6,203,267 | B1 * | 3/2001 | Heiple et al. | 414/722 |
| 6,209,237 | B1 | 4/2001 | Heiple et al. | |
| 2002/0101107 | A1 * | 8/2002 | Cunningham et al. | 297/377 |
| 2003/0167662 | A1 * | 9/2003 | Desrochers | 37/406 |
| 2007/0289173 | A1 * | 12/2007 | Riffle | 37/403 |

FOREIGN PATENT DOCUMENTS

| | | |
|---|---|---|
| FR | 2849008 | 12/2002 |

* cited by examiner

*Primary Examiner* — Saul Rodriguez
*Assistant Examiner* — Brendan Tighe
(74) *Attorney, Agent, or Firm* — Bart Fisher

(57) ABSTRACT

A bucket thumb assembly mountable to a lifting arm of a machine (e.g., an excavator or a backhoe loader) includes a mounting lug and a thumb member pivotably coupled to the mounting lug. The bucket thumb assembly also includes a link member extending from the thumb member. The link member has a first aperture at a first end of the link member. The link member has an indicator block extending from the link member. The bucket thumb assembly further includes a mounting plate having a second aperture and a catch. The mounting plate is configured to selectively couple with the link member using a pin inserted through the first and second apertures when the indicator block is resting on the catch such that a face surface on the indicator block and a face surface of the catch are substantially co-planar.

18 Claims, 8 Drawing Sheets

BUCKET THUMB ASSEMBLY

TECHNICAL FIELD

The present disclosure relates generally to a thumb assembly used with a pivoting bucket on a machine, such as an excavator. More specifically, the present disclosure relates to a bucket thumb assembly having a visual connection assist system with a connecting pin alignment indicator.

BACKGROUND

A bucket thumb is generally understood in the industry as an implement, which is mounted on an underside of a stick on an excavator boom. The thumb generally opposes the excavator bucket for grasping material held between the bucket and the thumb. There are two main types of bucket thumbs, stiff link thumbs and hydraulically actuated thumbs. Stiff link thumbs are fixed or rigidly orientated relative to the stick and/or the bucket. Conversely, hydraulically actuated thumbs pivot or otherwise move relative to the stick and/or the bucket using a hydraulic cylinder actuated by hydraulic force. In use, the bucket is rotated relative to the stick to grasp and hold material between the bucket and the thumb.

Stiff link thumbs may be connected to the stick with a strut, the position of which can be adjusted to permit adjustment of the angle of the thumb relative to the stick. The strut may include a rigid link detachably securable, using one or more pins, to one of a number attachment points provided on the stick. For example, excavator thumb assemblies typically lock the thumb into a working position with one or more pins frictionally received through one or more holes on the link and one or more corresponding holes on the bracket or attachment point on the stick. Proper alignment of these holes on the link, the bracket, and the attachment point is difficult because thumb assemblies and links can exceed several hundred of pounds.

U.S. Pat. No. 6,203,267 discloses a thumb assembly with a rigid strut connected to a bracket by a pin. The strut includes a T-shaped end that is received in a complementary slot in the bracket. While the T-shaped end and the slot will support the weight of the strut and thumb when the pin is removed to aid in connecting the strut to the bracket, the thumb assembly disclosed in the '267 patent adds significant complexity and cost to the thumb design. Additionally, the thumb assembly disclosed in the '267 patent does not provide a visual indication when the holes in the strut and bracket are sufficiently aligned to insert the connecting pins. Thus, the machine operator must have an additional person located near the bucket or exit the operator station to determine when the holes are sufficiently aligned to insert the connecting pins. This adds time, difficulty, and cost to connecting and adjusting the thumb assembly.

The present disclosure provides a bucket thumb assembly that is directed to overcoming one or more of the problems discussed above.

SUMMARY OF THE DISCLOSURE

In one aspect, the present disclosure provides a bucket thumb assembly mountable to a lifting arm of a machine such as an excavator or a backhoe loader. The bucket thumb assembly includes a mounting lug and a thumb member pivotably coupled to the mounting lug. The bucket thumb assembly also includes a link member extending from the thumb member. The link member has a first aperture at a first end of the link member. The link member has an indicator block extending from the link member. The bucket thumb assembly further includes a mounting plate having a second aperture and a catch. The mounting plate is configured to selectively couple with the link member using a pin inserted through the first and second apertures when the indicator block is resting on the catch such that a face surface on the indicator block and a face surface of the catch are substantially co-planar.

In another aspect, the present disclosure provides a bucket thumb assembly including a mounting lug and a thumb member pivotably coupled to the mounting lug. A link member extends from the thumb member. The link member has a first aperture and an indicator block extending from the link member proximate the first aperture. The bucket thumb assembly also includes a mounting plate. The mounting plate has a second aperture and a catch located proximate the second aperture. The link member is configured to selectively couple with the mounting plate using a pin inserted into the first and second apertures. The indicator block and the catch are configured to work in conjunction with one another to indicate that the thumb member is positioned with the first and second apertures sufficiently co-axial to insert the pin through the first and second apertures, or to indicate a direction to move the thumb member so that the first and second apertures will be sufficiently co-axial to insert the pin through the first and second apertures.

In yet another aspect, the present disclosure provides a machine. In an embodiment, the machine includes a power source configured to provide power to the machine. The machine also includes an operator station configured to allow an operator to control operations of the machine. In addition, the machine includes an implement system coupled to the machine and configured to be operated from the operator station using power from the power source. In an embodiment, the implement system includes a boom pivotably coupled to the machine and a bucket operatively and pivotably coupled to the boom. A thumb assembly is operatively coupled to the boom. The thumb assembly includes a mounting lug having a mounting lug aperture. A thumb member is pivotably coupled to the mounting lug at the mounting lug aperture. A link member extends from the thumb member and has a base mounting aperture at an end of the link member that is substantially opposite the thumb member. The link member further has an indicator block extending from the link member proximate the base mounting aperture. A mounting plate has a link mounting aperture and a catch located proximate the link mounting aperture. The link mounting aperture is configured to selectively couple with the base mounting aperture using a pin. The indicator block and the catch are configured to work in conjunction with one another to indicate that the thumb member is positioned too far forward, too far rearward, or sufficiently to insert the connecting pin.

Other features, aspects, and advantages of this disclosure will be apparent from the following description and the accompanying drawings.

BRIEF DESCRIPTION OF THE DRAWINGS

The drawings illustrate exemplary embodiments of the disclosure and when accompanied with the description provided herein serve to explain the present disclosure by way of example and should not be construed to limit the present disclosure.

DETAILED DESCRIPTION

The present disclosure relates generally to a thumb assembly configured for use with a bucket on a machine, such as a material-handling machine. More specifically, the present disclosure relates to a bucket thumb assembly having a connection assist system with a connecting pin alignment indicator. While embodiments discussed herein and shown throughout the figures relate to a thumb assembly coupled to an excavator machine, it should be readily understood by those having ordinary skill in the art that embodiments of the present disclosure might be easily coupled to and used with other types of machines.

Figure 1:
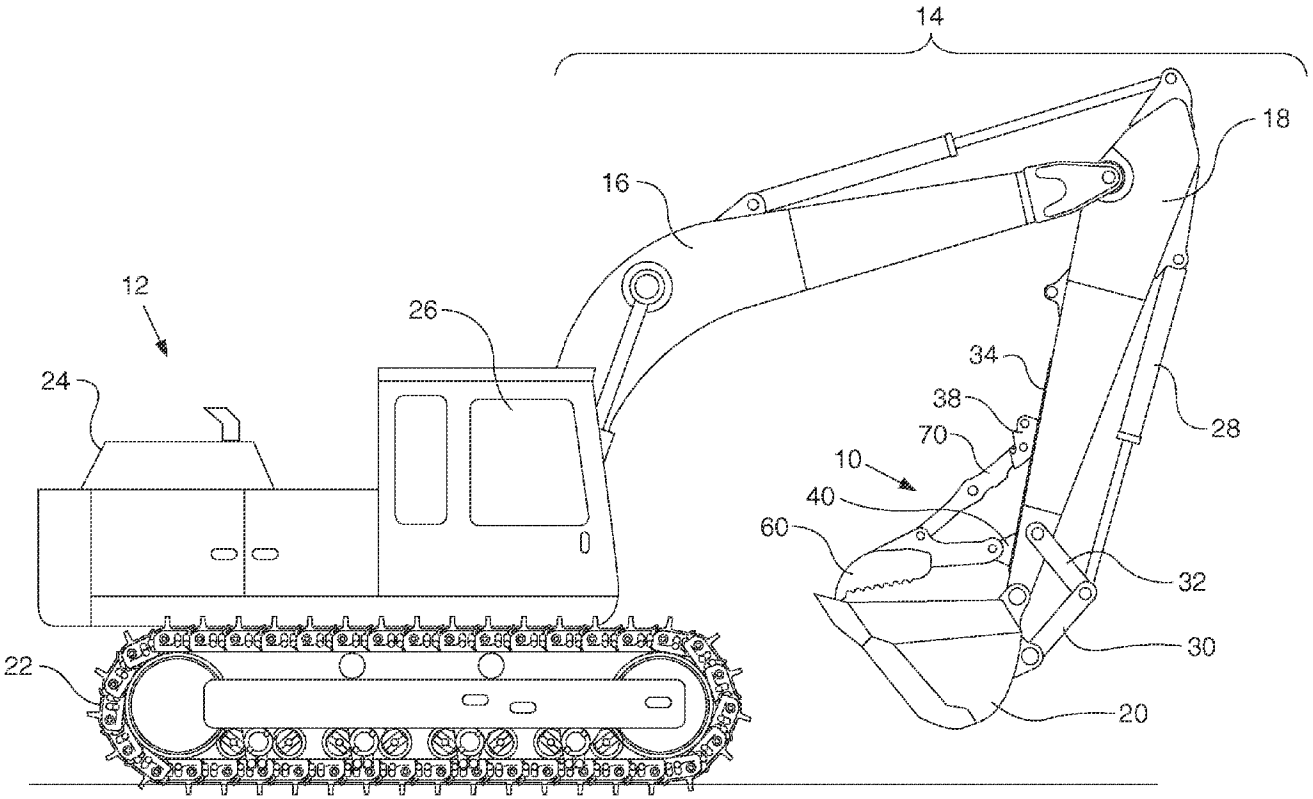
FIG. 1 illustrates a side view of a machine provided with a bucket thumb assembly having a connection assist system with a connecting pin alignment indicator according to an embodiment of the present disclosure.

FIG. 1 illustrates a side view of a machine (e.g., an excavator) 12 provided with an embodiment of a bucket thumb assembly 10 having a connection assist system with a connecting pin alignment indicator. FIGS. 2-9A illustrate various views of embodiments of the thumb assembly 10 and the connecting pin alignment indicator system.

The Machine 12 may embody a fixed or mobile machine that performs some type of operation associated with an industry such as mining, construction, farming, transportation, or any other industry. For example, machine 12 may be an earth-moving machine such as an excavator, a backhoe, a material-handling machine, or any other machine that could utilize a thumb assembly.

Machine 12 may include an implement system 14 that includes a boom 16, a stick or lifting arm 18 pivotally attached to the boom 16, a bucket 20 pivotally attached to the stick 18, and the thumb assembly 10 pivotally attached to the stick 18. The machine 12 may also include a drive system 22 for propelling the machine 12, a power source 24 that provides power to the implement system 14 and the drive system 22, and an operator station 26 for operator control of implement system 14 and drive system 22.

The stick or lifting arm 18 is hydraulically operated to move bucket 20 to a location where the bucket 20 can be curled to scoop up material (e.g., dirt, rocks, sand, bricks, and/or other materials) (not shown), and then to move the bucket 20 to a location where the bucket 20 can be uncurled to empty the scooped material from the bucket 20. The curling and uncurling of the bucket 20 may be controlled by a hydraulic ram/cylinder 28 connected to the stick 18 and one or more linkage members 30, 32, which are pivotally connected to the stick 18 and bucket 20. Control of the bucket 20 should be understood by those having ordinary skill in the art and thus does not warrant further explanation herein.

The power source 24 may include an engine such as, a diesel engine, a gasoline engine, a gaseous fuel-powered engine or any other type of combustion engine. It is contemplated that power source 24 may alternatively embody a non-combustion source of power such as a fuel cell, a power storage device, or any other type of power source. Power source 24 may produce a mechanical or electrical power output that may then be converted to hydraulic power for operating the implement system 14. The drive system 22 may include a track-drive system, a wheel-drive system, or any other type of drive system to propel the machine 12.

Figure 2:
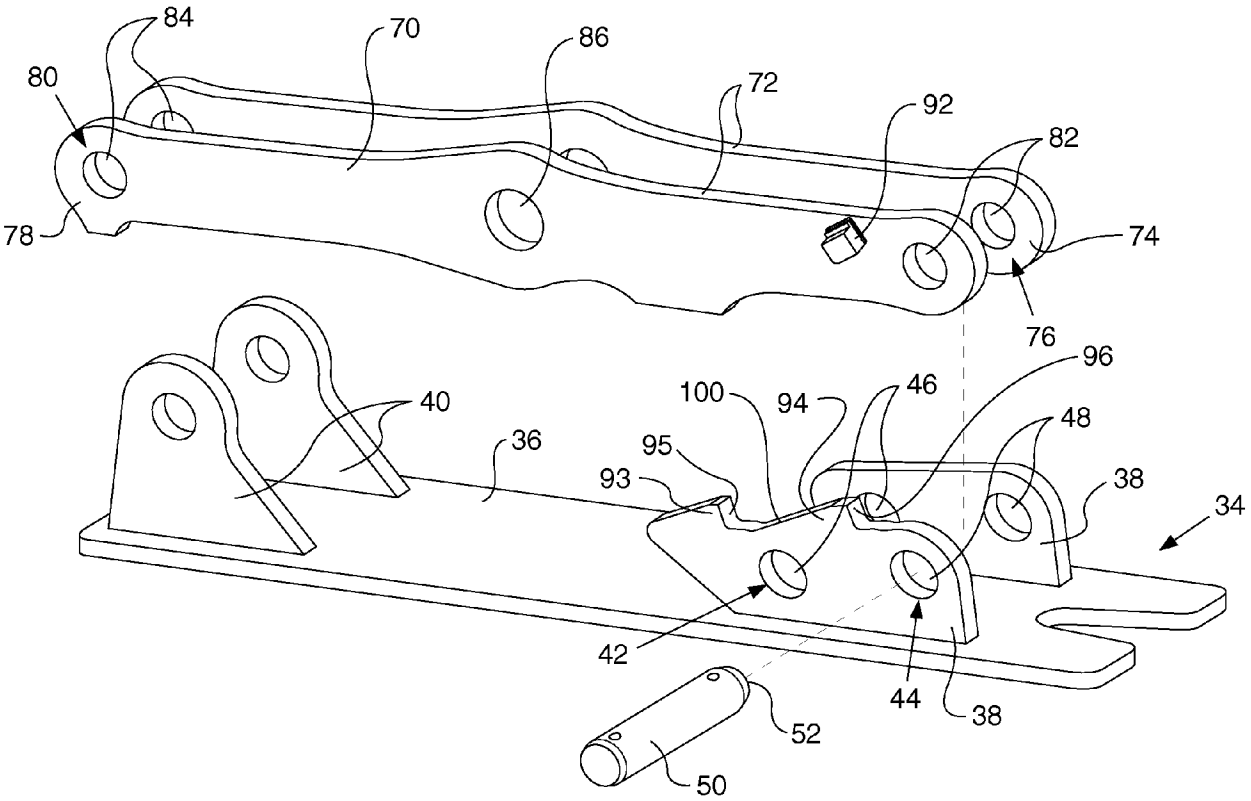
FIG. 2 illustrates an exploded view of a portion of the thumb assembly of FIG. 1.

The thumb assembly 10 is attached to a portion of machine 12 and includes a base member 34, a thumb member 60, a link member 70, and a connection assist system 90. Referring now to FIG. 2, the base member 34 may be mounted to the stick 18 by welding, fastening, or by any other appropriate way. In the illustrated example, the base member 34 includes a base plate 36, which is attached to the underside of the stick 18, for example, by welding. Mounted on the base plate 36 are two spaced apart link member mounting plates 38 and two spaced apart thumb mounting lugs 40. In other embodiments, different quantities of the link member mounting plates 38 and the thumb mounting lugs 40 may be used. Each link member mounting plate 38 is provided with one or more attachment points or pivot joint locations 42, 44. In the illustrated example, each link member mounting plate 38 includes two pivot joint locations 42, 44, which are formed as a first pair of coaxial, circular link mounting apertures 46 and a second pair of coaxial, circular link mounting apertures 48 through which a removable connecting pin 50 can be inserted. Each pair of link mounting apertures 46, 48 correspond to a different working position or orientation of the thumb assembly 10.

The pivot joint locations 42, 44 may take forms other than the simple circular apertures illustrated in the figures. For example, each pivot joint location 42, 44 may include a coupling system for receiving one or more fasteners, which hold a mount (not shown) for a bearing or pin, so that a link member can be pivotally secured to the base member 34. Additionally, other embodiments may include a different number of pivot joint locations. In other words, the pivot joint locations 42, 44 may be formed having any suitable number and shape of apertures and any type of pin or other coupler may be used therein.

The link member mounting plates 38 and thumb mounting lugs 40 of the base member 34 may be secured to the stick 18 without the base plate 36. Thus, the base member 34 may be a number of unconnected pieces. The thumb mounting lugs 40 may be replaced by any other suitable pivot-type mounting system. Additionally, the thumb member 60 can be arranged to pivot on the pivot axis of the bucket 20.

Figure 3:
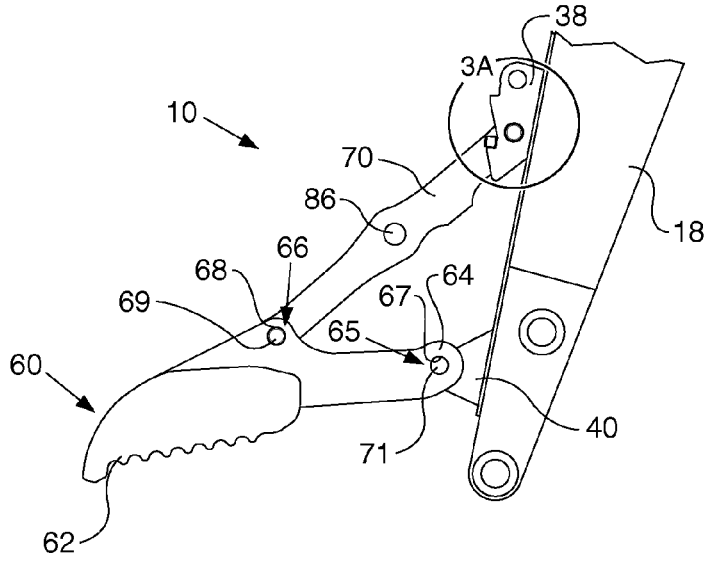
FIG. 3 illustrates a diagrammatic illustration of the thumb assembly of FIG. 1 in a first working position.

Referring now to FIG. 3, the thumb member 60 may be configured in a variety of ways. Any structure capable of being coupled to the lifting arm and cooperate with a bucket to grasp material to be handled may be used. In the depicted embodiment, the thumb member 60 is a rigid structure that includes a first end 62 configured to engage the material to be handled and a second end 64 having a first pivot joint location 65 for connecting to the base member 34. The thumb member 60 also includes a second pivot joint location 66 for connecting to the link member 70. The first pivot joint location 65 is formed as a pair of coaxial, circular base mounting apertures 67 (only one shown) pivotally connected to the thumb mounting lugs 40 via a thumb mounting pin 71. The second pivot joint location 66 is formed as a pair of coaxial, circular link mounting apertures 68 (only one shown) pivotally connected to the link member 70 via a link mounting pin 69 or any other suitable pivotal connection.

Referring now to FIGS. 2 and 3, the link member 70 may also be configured in a variety of ways. Any rigid link capable of being pivotally connected to both the thumb member 60 and the base member 34 may be used. In the illustrated embodiment, the link member 70 includes two connected parallel plates 72. The link member 70 includes a first end 74 having a first pivot joint location 76 and a second end 78 having a second pivot joint location 80. In the illustrated example, the first pivot joint location 76 is formed as a first pair of circular base mounting apertures 82 through which the removable pivot pin 50 can be located. Likewise, the second pivot joint location 80 is formed as a second pair of circular thumb mounting apertures 84 through which link mounting pin 69 can be located. It should be understood that in various embodiments the link member 70 may be integral with the thumb member 60.

The pivot joint locations 76, 80 may take forms other than the simple apertures illustrated. For example, each pivot joint location 76, 80 may comprise means for receiving one or more fasteners which hold a mount (not shown) for a bearing or pin, so that the link member 70 can be pivotally secured to the base member 34 at the first end 74 and pivotally secured to the thumb member 60 at the second end 78. Thus, in other embodiments, more or fewer pivot joint locations can be provided and the pivot joint locations may be formed in any suitable manner, such as any suitable number and shape of apertures and any type of pin may be used.

The link member 70 may also include one or more storage position apertures 86 for holding the link member 70 in a storage position via the connecting pin 50 and the link mounting apertures 46, 48. In the depicted embodiment, the one or more storage position apertures 86 are formed as a pair of spaced apart circular apertures positioned between the base mounting apertures 82 at the first end 74 and the thumb mounting apertures 84 at the second end 78. For example, the storage position apertures 86 may be positioned along the length of the link member 70 approximately half way between the base mounting apertures 82 and the thumb mounting apertures 84. In the storage position, the link member 70 is folded back against the stick 18 such that the pin 50 (or other suitable holding device) can be received through both the storage position apertures 86 and the one set of link mounting apertures 46 or 48.

As shown in FIG. 2, removable connecting pin 50 is a generally cylindrical rod configured to be tightly received through various apertures in the thumb assembly 10. For example, the connecting pin 50 may be configured to be received through the base mounting apertures 82 and the storage position apertures 86 on the link member 70 and also through the link mounting apertures 46, 48 on the base member 34. The connecting pin 50 may include one or more tapered end(s) 52 to assist in installation of the pin through multiple apertures that are slightly misaligned. Thus, the connecting pin 50 may be tapered only on one end, on both ends, or may have a slight taper along the majority of the length of the pin 50. In an embodiment, the taper for tapered end 52 is approximately 10 degrees, however, other taper angles may be used. In addition, the connecting pin 50 may include one or more apertures through the pin 50 for receiving a keeper pin, such as a roll pin, a cotter pin, a lynch pin, etc. In an embodiment, connecting the pin 20 may be plated with a coating to reduce insertion/retraction friction or to reduce corrosion. One example of such coating is a chrome coating. However, other coatings may be used.

The connection assist system 90 may be configured in a variety of ways. Any system disposed on at least one of the link member 70 and the base member 34 and capable of providing a visual indication that the thumb member 60 and the link member 70 are in a position such that the link member 70 can be coupled to one set of the mounting aperture 46, 48 may be used. For example, in a position such that the removable connecting pin 50 can be received through link mounting apertures 46, 48 on the base member 34 and also through the base mounting aperture(s) 82 on the link member 70. Thus, the connection assist system 90 operates as a connecting pin alignment indicator.

In the depicted embodiment, the connection assist system 90 is configured as a detent or catch system. In particular, the connection assist system 90 includes a projection or indicator block 92 on the link member 70. A first detent or catch 93 is on the base member 34. A second detent or catch 94 is also on the base member 34, but separated from the first detent or catch 93.

The projection or indicator block 92 and the detents or catches 93, 94 may be configured in a variety of ways. Any structure or set of components that can cooperate to provide a visual indication may be used. In the depicted embodiment, the indicator block 92 is located on one of the pair of parallel plates 72 of the link member 70 in proximity of one of the base mounting apertures 82. In an embodiment, the indicator block 92 is configured as a substantially square block (e.g., an approximately one inch block) extending generally perpendicular from one of the plates 72 and is configured to generally mate with one of the catches 93, 94. The projection or indicator block 92 can be attached to the link member 70 in any suitable manner, such as through welding. On a corresponding one of the pair of link member mounting plates 38, the first catch 93 and the second catch 94 are configured to present first and second shoulders 95, 96, respectively, which the indicator block 92 may engage as the first end 74 of the link member 70 moves when the thumb member 60 is engaged by the bucket 20 and the bucket 20 is pivoting. It should be understood that the shape, size, location, and number of projections and/or catches may vary for different embodiments.

Figure 4:
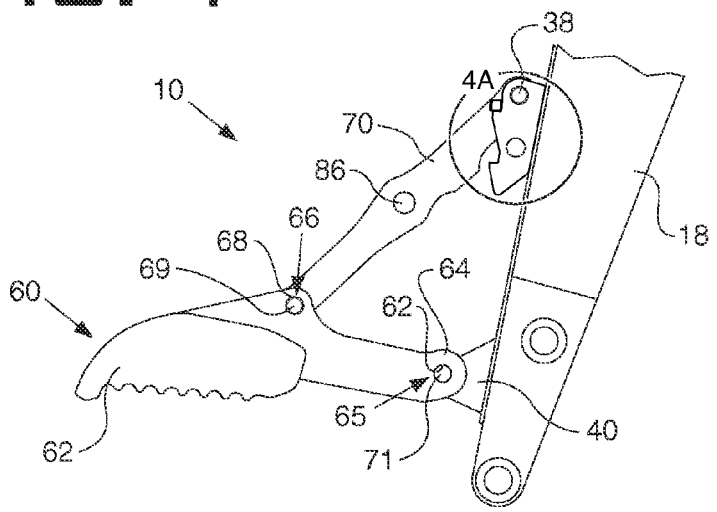
FIG. 4 illustrates a diagrammatic illustration of the thumb assembly of FIG. 1 in a second working position.
Figure 4A:
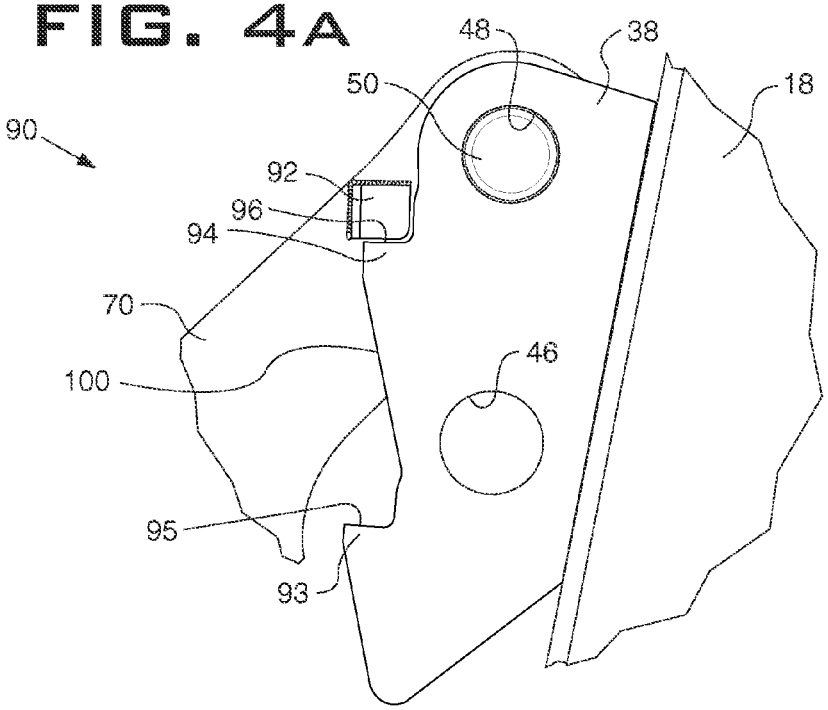
FIG. 4A illustrates a partial enlarged view of the connection assist system of the thumb assembly of FIG. 1 in the second working position.

Referring now to FIGS. 3-4A, in operation, the thumb assembly 10 shown in the figures has two working positions or orientations, such as approximately 90 degrees and approximately 105 degrees from a central axis of the stick 18. However, in other embodiments, the thumb assembly member 60 may have more or less than two working positions or orientations, which may be at any desirable angle from the central axis of the stick 18. In both working positions illustrated herein, the base member 34 is connected to the stick 18 and the thumb member 60 is pivotally connected to the base member 34. The second end 78 of the link member 70 is coupled to the thumb member 60 and the first end 74 of the link member 70 is connected to the base member 34 via the connecting pin 50.

Figure 3A:
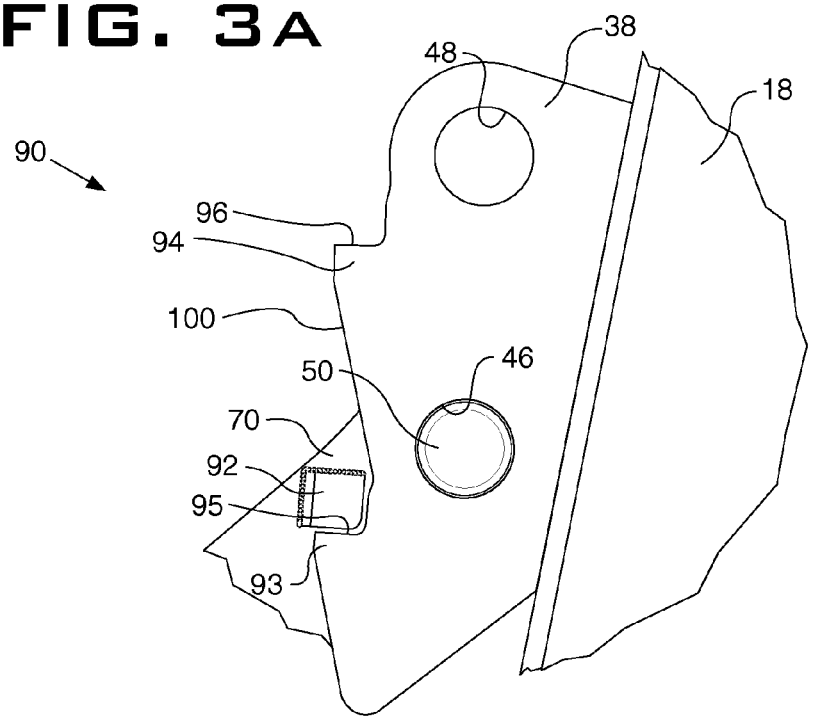
FIG. 3A illustrates a partial enlarged view of a connection assist system of the thumb assembly of FIG. 1 in the first working position.

The difference between the first working position (e.g., FIGS. 3 and 3A) and second working position (e.g., FIGS. 4 and 4A) is which pair of link mounting apertures 46 or 48 to which the first end 74 of the link member 70 attaches. In the position illustrated in FIGS. 3 and 3A, the link member 70 is attached to the first pair of link mounting apertures 46, and in the position illustrated in FIGS. 4 and 4A, the link member 70 is attached to the second pair of link mounting apertures 48.

The thumb assembly 10 is configured to be easily moved between the first and second working positions. For example, to move from the first position to the second position, the stick 18 and bucket 20 are curled into a position generally illustrated in FIG. 1 (e.g., a position in which the bucket 20 is in contact with the thumb member 60). In this position, the bucket 20 supports the weight of the thumb member 60 and link member 70 so that the connecting pin 50 can be removed to decouple the first end 74 of the link member 70 from the base member 34. With the connecting pin 50 removed, the indicator block 92 engages the first catch 93 such that the connect-assist system 90 can support or partially support the weight of the thumb member 60 and link member 70.

With the connecting pin 50 removed, the bucket 20 can then be further curled (e.g., clockwise in the view of FIG. 1) to pivot the thumb member 60 (e.g., clockwise). Because the second end 78 of the link member 70 is still coupled to the thumb member 60, the link member 70 will follow the movement of the thumb member 60. Due to the angle of the stick 18, the indicator block 92 will leave the first detent or catch 93 and slide along a face edge 100 of the link member mounting plates 38, or be moved without contacting the top edge 100, until it reaches the second detent or catch 94. Once the indicator block 92 reaches the second detent or catch 94, the indicator block 92 will fall into or be caught by the second detent or catch 94. In this position, the thumb member 60 and the link member 70 are in a position such that the connecting pin 50 can be received through both the second link mounting aperture(s) 48 and the base mounting aperture(s) 82.

The indicator block 92 and the second catch 94 cooperate to provide a visual indication that the link member 70 and base member 34 are in a position to be coupled with the connecting pin 50 (e.g., the second link mounting aperture(s) 48 and the base mounting aperture(s) 82 are sufficiently aligned to receive the connecting pin 50). In connection with the bucket 20, the indicator block 92 and the second catch 94 may also cooperate to support or partially support the weight of the thumb member 60 and link member 70.

Figure 5:
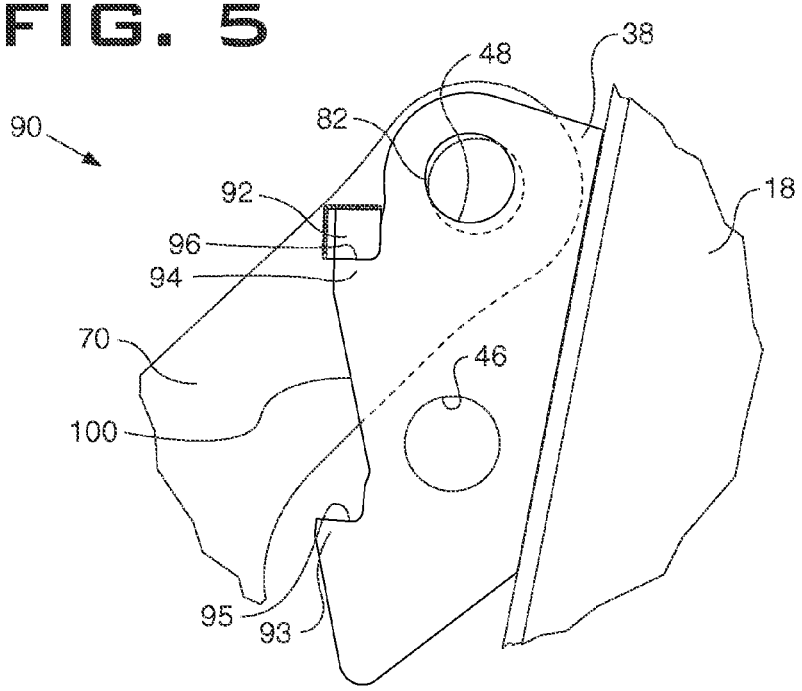
FIG. 5 illustrates a partial enlarged view of the connection assist system of the thumb assembly of FIG. 1 without a connecting pin inserted.
Figure 6:
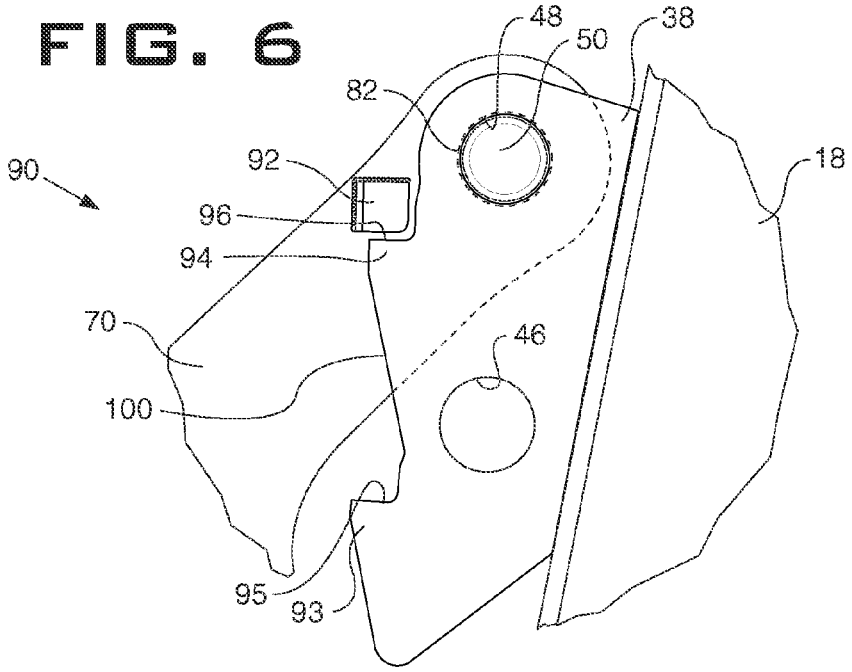
FIG. 6 illustrates a partial enlarged view of the connection assist system of the thumb assembly of FIG. 1 with the connecting pin inserted.

Referring to FIGS. 5 and 6, the base mounting apertures 82 on the link member 70 and the second link mounting apertures 48 on the base member 34 overlap axially enough to allow the connecting pin 50 to be inserted through both the base mounting apertures 82 and second link mounting apertures 48. In the depicted embodiment, without the pin 50 installed, the base mounting apertures 82 and link mounting apertures 46 are not coaxially aligned (as shown in FIG. 5). In other words, the apertures 82 and 46 are not concentric. Instead, the base mounting apertures 82 and second link mounting apertures 48 are slightly misaligned. In an embodiment, a misalignment of base mounting apertures 82 and link mounting apertures 48 is approximately 3.5 mm. However, other dimensions for alignment or misalignment may be used. The slight misalignment causes the indicator block 92 to lift off of the link member mounting plate 38. This assures that the indicator block 92 is not loaded when the thumb assembly 10 is in use. Otherwise large load pressures would be present at the indicator block 92, deforming and wearing out the link member mounting plate 38.

Installation of the pin 50 aligns the base mounting apertures 82 and the second link mounting apertures 48 coaxially, which results in the indicator block 92 disengaging from the second detent or catch 94 (as shown in FIG. 6). The tapered end 52 of the connecting pin 50 helps facilitate insertion into the slightly misaligned apertures and subsequent aligning of the apertures. Thus, when the bucket 20 is uncurled, the connecting pin 50 now supports the weight of the thumb member 60 and link member 70. In other embodiments, however, the base mounting apertures 82 and the link mounting apertures 46, 48 may be coaxially aligned when the indicator block engages the detent or catch. As should be understood, movement from the second position to the first position can be accomplished in a similar manner.

Figure 7:
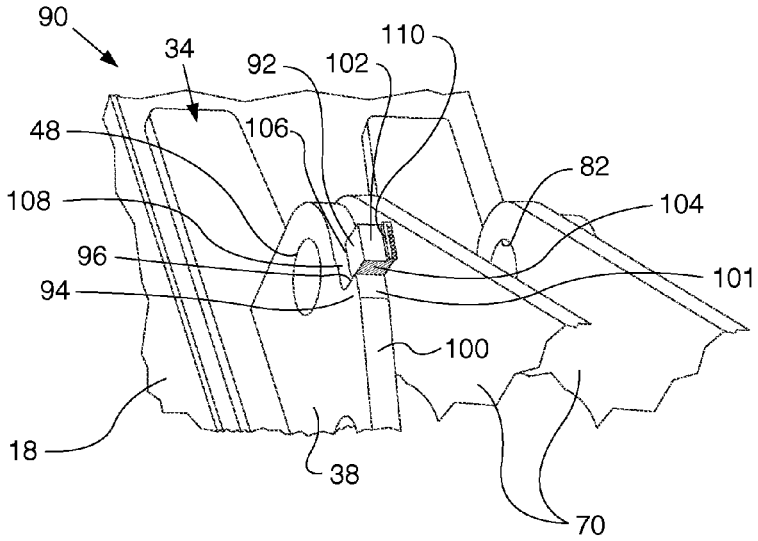
FIG. 7 illustrates a partial enlarged isometric view of the connection assist system of the thumb assembly of FIG. 1, as seen from the operator's station of the machine, indicating that the thumb is too far forward.
Figure 7A:
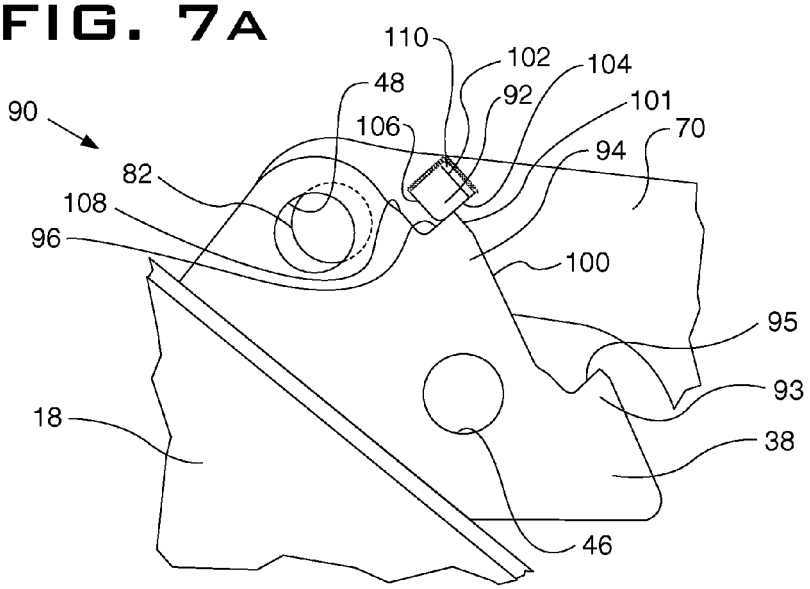
FIG. 7A illustrates an enlarged partial side view of the connection assist system of the thumb assembly of FIG. 1 indicating that the thumb is too far forward.
Figure 8:
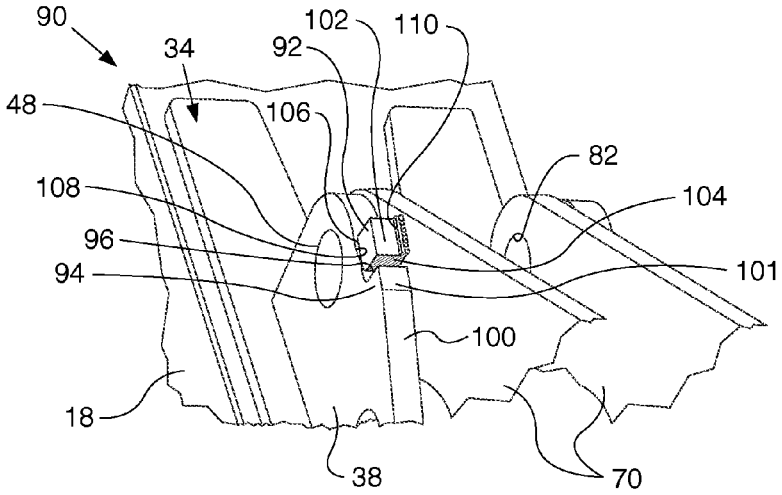
FIG. 8 illustrates a partial enlarged isometric view of the connection assist system of the thumb assembly of FIG. 1, as seen from the operator's station of the machine, indicating that the thumb is too far rearward.
Figure 8A:
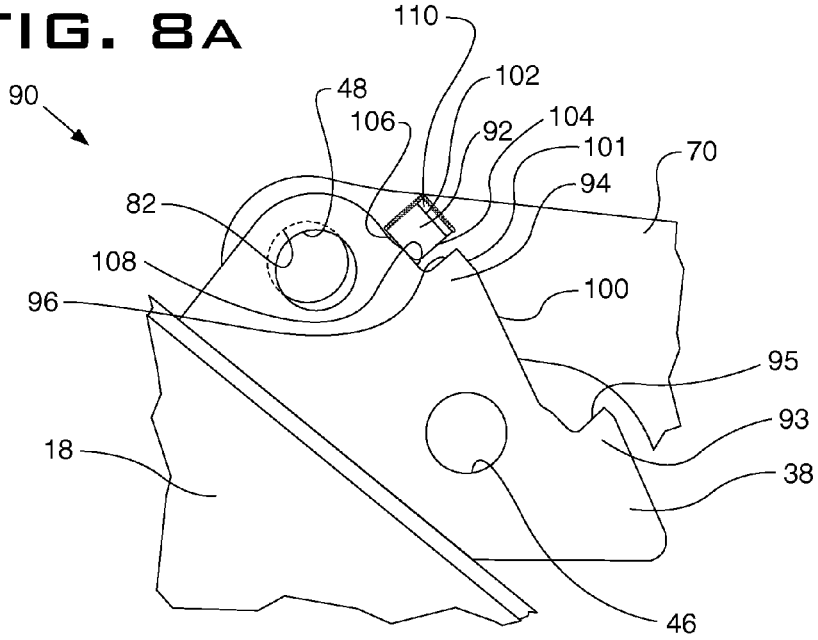
FIG. 8A illustrates an enlarged partial side view of the connection assist system of the thumb assembly of FIG. 1 indicating that the thumb is too far rearward.
Figure 9:
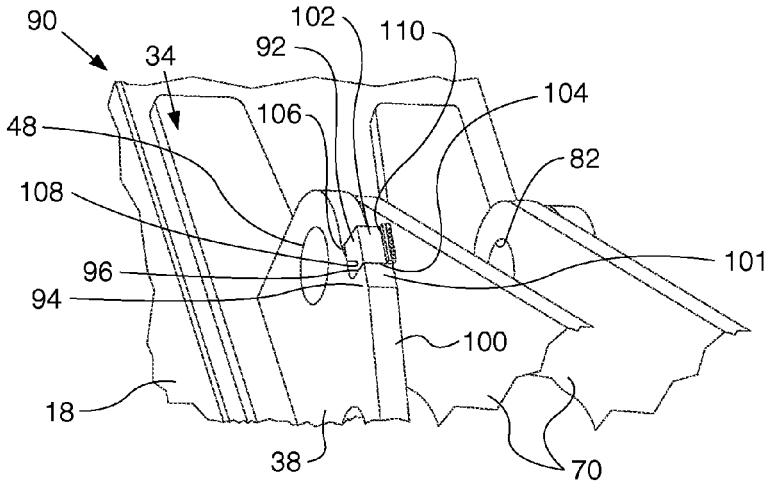
FIG. 9 illustrates a partial enlarged isometric view of the connection assist system of the thumb assembly of FIG. 1, as seen from the operator's station of the machine, indicating that the thumb is properly aligned for inserting the connecting pin.
Figure 9A:
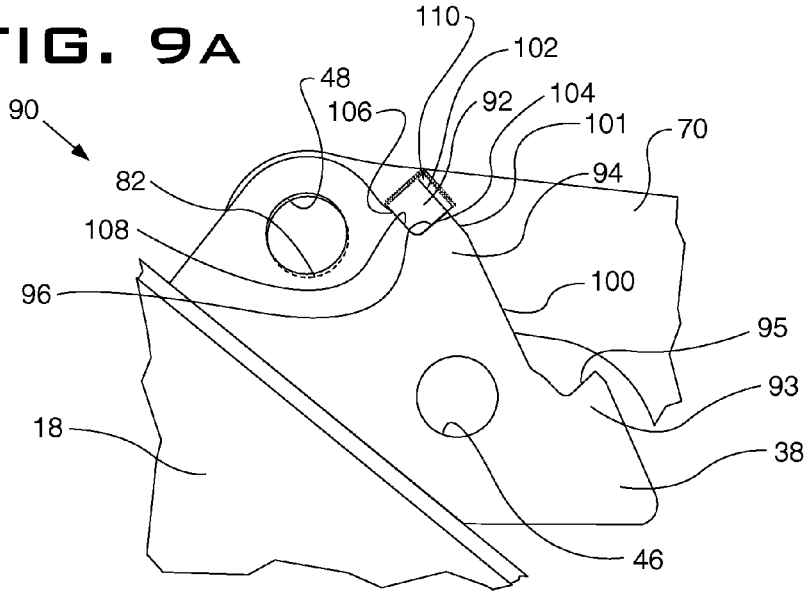
FIG. 9A illustrates an enlarged partial side view of the connection assist system of the thumb assembly of FIG. 1 indicating that the thumb is properly aligned for inserting the connecting pin.

FIG. 7 illustrates a partial enlarged isometric view of the connection assist system 90 of the thumb assembly 10, as seen from the operator's station 26 of the machine 12, indicating that the thumb member 60 is too far forward to insert the connecting pin 50. FIG. 7A illustrates an enlarged partial side view of the connection assist system 90 of the thumb assembly 10 indicating that the thumb member 60 is too far forward to insert the connecting pin 50. FIG. 8 illustrates a partial enlarged isometric view of the connection assist system 90 of the thumb assembly 10, as seen from the operator's station 26 of the machine 12, indicating that the thumb member 60 is too far rearward to insert the connecting pin 50. FIG. 8A illustrates an enlarged partial side view of the connection assist system 90 of the thumb assembly 10 indicating that the thumb member 60 is too far rearward to insert the connecting pin 50. FIG. 9 illustrates a partial enlarged isometric view of the visual connection assist system 90 of the thumb assembly 10, as seen from the operator's station 26 of the machine 12, indicating that the thumb member 60 is properly aligned for inserting the connecting pin 50. FIG. 9A illustrates an enlarged partial side view of the connection assist system 90 of the thumb assembly 10 indicating that the thumb member 60 is properly aligned for inserting the connecting pin 50.

As described above, once the indicator block 92 reaches the detent or catch 94, the indicator block 92 will fall into or be caught by the catch 94, thereby indicating sufficient alignment of link mounting apertures 48 and base mounting apertures 82 for receiving connecting pin 50. However, to further assist an operator in knowing when the indicator block 92 is caught by catch 94, the connection assist system 90 has the indicator block 92, the catch 94, and the shoulder 96 sized and located such that a dark portion or shadow on a lower surface 104 of the indicator block 92 will not be seen by the operator when indicator block 92 is caught by the catch 94 (e.g., resting on shoulder 96) (See FIGS. 7, 8, and 9). Specifically, a face surface 101 of the catch 94 and a face surface 102 of the indicator block 92 are aligned and substantially co-planar when base mounting apertures 82 and link mounting apertures 48 are sufficiently aligned to receive connecting pin 50.

A color differentiation or shadowed effect of the lower surface 104 will contrast with colored portions of the connection assist system 90 in proximity to the indicator block 92, thereby allowing the operator to easily see such contrast from the operator station 26. Accordingly, an operator, without additional assistance, can locate the thumb assembly 10 for inserting the connecting pin 50. As such, this system saves time and money when adjusting the thumb assembly 10.

In an embodiment, rear surface 106, lower surface 104, and face surface 102 of indicator block 92 are machined or otherwise formed to have desired dimensions relative to base mounting apertures 82. Similarly, rear surface 108, face surface 101, and second shoulder 96 of catch 94 are machined or otherwise formed to have dimensions relative to link mounting apertures 48. Accordingly, dimensions of rear surface 106, lower surface 104, and face surface 102 of indicator block 92 mate with corresponding surfaces (e.g., rear surface 108, shoulder 96, and face surface 101) of catch 94 to provide sufficient alignment to receive connecting pin 50 in link mounting apertures 48 and base mounting apertures 84 when the dark or shadowed lower surface 104 of the indicator block 92 is hidden from view relative to the machine operator because it is resting on the second shoulder 96. As should be understood, alignment of the face surface of the catch and the face surface of the indicator block are similar for movement from the second position to the first position.

In an embodiment, machining of rear surface 106, lower surface 104, and face surface 102 of indicator block 92 relative to base mounting apertures 82 are held to a tolerance of approximately 0.1 mm. Similarly, machining of rear surface 108, face surface 101, and second shoulder 96 of catch 94 relative to link mounting apertures 48 may be held to a tolerance of approximately 0.1 mm. However, it should be understood that any desired tolerance may be used with the connection assist system 90.

Indicator block 92 may have a step 110 formed in the face surface 102 of the indicator block 92 to provide a surface for welding or otherwise attaching the indicator block 92 to link member 70.

Industrial Applicability

The disclosed thumb assemblies 10 are particularly suitable for machines, such as excavators, for purposes of cooperating with a bucket 20 to grasp objects between the thumb member 60 and bucket 20. The disclosed thumb assembly 10 may be easily placed in various working positions despite being heavy and cumbersome. The connection assist system 90 provides a convenient visual connecting pin alignment indicator, which indicates that the thumb member 60 and the link members 70 are in a position such that the link member 70 may be connected to the base member 34. Further, the connection assist system 90 can support or partially support the weight of the thumb member 60 and link member 70 while an operator makes the connection between the link member 70 and one of the pivot joint locations 42, 44 on the stick 18. Thus, for example, an operator at the operator station 26 has a clear indication of when the apertures on the link member 70 and base member 34 are sufficiently aligned (even if partially misaligned) to receive connecting pin 50, without the need for a spotter located at the bucket 20. For example, when the lower surface of the indicator block is not visible because the face surface of the catch and the face surface of the indicator block are co-planar and are adjacent one another (see FIGS. 7, 7A, 8, 8A, 9, and 9A), the operator knows that the apertures are sufficiently aligned.

It should be apparent to those skilled in the art that various modifications and variations can be made to the thumb assembly and the method of moving a thumb member of a thumb assembly. Other embodiments will be apparent to those skilled in the art from consideration of the specification and practice of the disclosed thumb assembly and the method of moving a thumb member of a thumb assembly. It is intended that the specification and examples be considered as exemplary only, with a true scope being indicated by the following claims and their equivalents.

What is claimed is:

1. A bucket thumb assembly comprising:
- a mounting lug;
- a thumb member pivotably coupled to the mounting lug;
- a link member extending from the thumb member to a first end, the link member having:
  - a first aperture at the first end of the link member; and
  - an indicator block extending from the link member, the indicator block being located between the thumb member and the first aperture;
- a mounting plate having:
  - a second aperture; and
  - a catch having twp orthogonal sides that engage corresponding faces of the indicator block, so that the first aperture and the second aperture are substantially aligned; and
- a pin inserted through the first aperture and the second aperture to a couple the link member to the mounting plate when the corresponding faces of the indicator block are in contact with each of the orthogonal sides of the catch.

2. The bucket thumb assembly of claim 1, wherein the mounting plate further includes a third aperture and a second catch, the mounting plate configured to selectively couple with the link member using the pin inserted through the first and third apertures when the indicator block is resting on the second catch such that the face surface on the indicator block and a face surface of the second catch are substantially co-planar.

3. The bucket thumb assembly of claim 2, wherein the thumb member is at a first orientation when the pin is inserted through the first and second apertures, and wherein the thumb member is at a second orientation when the pin is inserted through the first and third apertures.

4. The bucket thumb assembly of claim 1, wherein the link member extends from the thumb member via a pivoting joint.

5. The bucket thumb assembly of claim 1, further comprising a base plate supporting both the mounting lug and the mounting plate.

6. The bucket thumb assembly of claim 1, wherein the indicator block is formed having a step, and wherein the indicator block is welded to an outer surface of the link member at the step.

7. The bucket thumb assembly of claim 1, wherein the link member is configured to be coupled with the mounting plate to place the thumb member in a storage position.

8. The bucket thumb assembly of claim 1, wherein the first aperture and the second aperture are not concentric when the indicator block is resting on the catch and the face surface on the indicator block and a face surface of the catch are substantially co-planar so that after insertion of the pin, the indicator block is raised out of contact with the catch so that the indicator block is free of any load during operation of the bucket thumb assembly.

9. The bucket thumb assembly of claim 8, wherein the first aperture and the second aperture are not concentric by a distance of approximately 3.5 mm.

10. The bucket thumb assembly of claim 9, wherein the second aperture and the first aperture are substantially concentric when the pin is inserted through the first and second apertures.

11. The bucket thumb assembly of claim 10, wherein the indicator block is separated by a distance from the catch when the first and second apertures are substantially concentric.

12. The bucket thumb assembly of claim 1, wherein the bucket thumb assembly is oriented such that a lower surface of the indicator block is substantially coplanar with a face surface of the catch when the first and second apertures are substantially aligned.

13. A bucket thumb assembly comprising:

a mounting lug;

a thumb member pivotably coupled to the mounting lug;

a link member extending from the thumb member, the link member having:

a first aperture; and an indicator block extending from the link member, the indicator block being located between the thumb member and the first aperture; and a mounting plate having:

a second aperture; and a catch located proximate the second aperture, the catch having orthogonal sides that engage corresponding faces of the indictor block, the link member configured to selectively couple with the mounting plate using a pin inserted into the the first and second apertures, the indicator block and the catch being configured to work in conjunction with one another in two dimension to indicate that the thumb member is positioned with the first and second apertures sufficiently co-axial to insert the pin through the first and second apertures when both of the orthogonal sides of the catch are engaged with the respective corresponding faces of the indicator block, or to indicate a direction in which the thumb member must be moved to cause the first and second apertures to be sufficiently co-axial to insert the pin through the first and second apertures when only one of the orthogonal sides of the catch is engaged with one respective corresponding face of the indicator block.

14. The bucket thumb assembly of claim 13, wherein indicator block and the catch are configured to work in conjunction with one another to indicate when the thumb member is oriented to permit insertion of the connecting pin through the first and second apertures.

15. The bucket thumb assembly of claim 13, wherein the mounting plate further includes a second catch and a third aperture, the indicator block and the second catch configured to work in conjunction with one another to indicate when the thumb member is oriented to permit insertion of the connecting pin through the first and third apertures.

16. A machine comprising:

a power source configured to provide power to the machine;

an operator station configured to allow an operator to control operations of the machine; and an implement system coupled to the machine and configured to be operated from the operator station using power from the power source, the implement system including, a boom pivotably coupled to the machine;

a bucket operatively and pivotably coupled to the boom; and a thumb assembly operatively coupled to the boom, the thumb assembly including, a mounting lug having a mounting lug aperture;

a thumb member pivotably coupled to the mounting lug at the mounting lug aperture;

a link member extending from the thumb member; the link member having a base mounting aperture at an end of the link member that is substantially opposite the thumb member, the link member further having an indicator block extending from the link member proximate the base mounting aperture; and a mounting plate having a link mounting aperture and a catch located proximate the link mounting aperture, the catch having two orthogonal sides that engage corresponding faces of the indicator block, the link mounting aperture is configured to selectively couple with the base mounting aperture using a pin, the indicator block and the catch configured to work in conjunction with one another to indicate that the thumb member is positioned, too far forward to insert the pin when only a first orthogonal side of the catch is engaged with a first face of the indicator block, too far rearward to insert the pin when only a second orthogonal side of the catch is engaged with a second face of the indicator block, or sufficiently to insert the connecting pin when both orthogonal sides of the catch are engaged with both faces of the indicator block.

17. The machine of claim 16, further including a propulsion system coupled to the machine and configured to propel the machine using power from the power source.

18. The machine of claim 16, wherein a spatial relationship between the indicator block and the catch is visible from the operator station of the machine.

* * * * *